US006001131A

United States Patent [19]

Raman

[11] Patent Number: 6,001,131

[45] Date of Patent: Dec. 14, 1999

[54] AUTOMATIC TARGET NOISE CANCELLATION FOR SPEECH ENHANCEMENT

[75] Inventor: Vijay Rangan Raman, Greenwich, Conn.

[73] Assignee: Nynex Science & Technology, Inc., White Plains, N.Y.

[21] Appl. No.: 08/394,111

[22] Filed: Feb. 24, 1995

[51] Int. Cl.[6] ..... G10L 9/00

[52] U.S. Cl. ..... 703/226; 704/233

[58] Field of Search ..... 395/2.35, 2.37; 704/226, 228, 233, 227; 379/3, 406, 410; 381/73.1, 317, 94.1, 94.2, 94.3, 94.4, 94.5, 94.6, 94.7, 94.8, 94.9

[56] References Cited

U.S. PATENT DOCUMENTS

| | | | |
|---|---|---|---|
| 3,403,224 | 9/1968 | Schroeder | 179/1 |
| 3,974,336 | 8/1976 | O'Brien | 179/1 SA |
| 4,628,529 | 12/1986 | Borth et al. | 381/94 |
| 4,630,304 | 12/1986 | Borth et al. | 381/94 |
| 4,630,305 | 12/1986 | Borth et al. | 381/94 |
| 4,696,040 | 9/1987 | Doddington et al. | 381/46 |
| 4,720,802 | 1/1988 | Damoulakis et al. | 364/513.5 |
| 4,918,732 | 4/1990 | Gerson et al. | 381/43 |
| 5,012,519 | 4/1991 | Adlersberg et al. | 381/47 |
| 5,295,225 | 3/1994 | Kane et al. | 395/2.35 |
| 5,390,280 | 2/1995 | Kato et al. | 395/2.42 |
| 5,544,250 | 8/1996 | Urbanski | 381/94 |
| 5,550,924 | 8/1996 | Helf et al. | 381/94 |

OTHER PUBLICATIONS

Noise Adaptation in a Hidden Markov Model Speech Recognition System –"Computer Speech & Language" –Dick Van Compernolle 1989 –pp. 151–167, Apr. 1989.

Environmental Robustness in Automatic Speech Recognition Alejandro Acero and Richard M. Stern pp. 849–852 Dept. of Elec. & Comp. Engineering & School of Comp. Science Carnagie Mellon University, Apr. 1990.

Robust Word Spotting in Adverse Car Environments pp. 1045–1048 Satoshi Nakamura, Toshio Akabane, Seiji Hamaguchi Sharp Corp. –Japan Eurospeech93, 1993.

IEEE Transactions on Speech & Audio Processing vol. 1 –No. 1, Jan. '83 "Energy Conduction Spectral Estimation for Recognition of Noisy Speech" Adoram Erell, Mitch Weintraub pp. 84–89.

IEEE Transactions on Acoustics, Speech, and Signal Processing vol. ASSP–27 No. 2 –Apr. '79 "Suppression of Acoustic Noise in Speech Using Special Subtraction" Steven Boll pp. 113–120.

"Experiments on Noise Reduction Techniques with Robust Voice Detector in Car Environments" A. Brancaccio and P. Pelaez Alcatel Italia –Lace Div. Research Center pp. 1259–1262 Eurospeech93, 1993.

"Automatic Word Recognition in Cars" Chatic Mokbel and Gerard Chollet, Sep. 1995.

*Primary Examiner*—Richemond Dorvil
*Attorney, Agent, or Firm*—Loren C. Swingle

[57] ABSTRACT

In a noise reduction communications system, where hands-free operations are utilized, a method and system are described for capturing the ambient noise immediately following speech, and using this sample as the basis for noise cancellation of the speech signal, either in a post-processing or real time processing mode.

15 Claims, 5 Drawing Sheets

AUTOMATIC TARGET NOISE CANCELLATION FOR SPEECH ENHANCEMENT

FIELD OF THE INVENTION

The present invention relates in general to communications systems, and more particularly to methods for reducing noise in voice communications systems.

BACKGROUND OF THE INVENTION

Background noise during speech can degrade voice communications. The listener might not be able to understand what is being transmitted, and is aggravated by trying to identify and interpret speech while noise is present. Also, in speech recognition systems, errors occur more frequently as the level of background (or ambient) noise increases.

Substantial efforts have been made to reduce the level of ambient noise in communications systems on a real-time basis. One is to filter out the low and high bands at the extremes of the voice band. The problem with this is that much noise is located in the same frequencies as usable speech.

Another is to actively estimate the noise and filter it out of the associated speech. This is generally done by quantifying the signal when speech is not present (presumed to be representative of ambient noise), and subtracting out that signal during speech. If the ambient noise is consistent between periods of speech and periods of non-speech, then such cancellation techniques can be very effective.

A typical state-of-the-art noise cancellation (speech enhancement) system generally has three components:

Speech/Noise Detector

Noise Estimator

Noise Canceller

A standard speech enhancement system might typically operate as follows:

The input signal is sampled and converted to digital values, called "samples". These samples are grouped into "frames" whose duration is typically in the range of 10 to 30 milliseconds each. An energy value is then computed for each such frame of the input signal.

A typical state-of-the-art Speech/Noise Detector is often accomplished via a software implementation on a general purpose computer. The system can be implemented to operate on incoming frames of data by classifying each input frame as ambient noise if the frame energy is below an energy threshold, or as speech if the frame energy is above the threshold. An alternative would be to analyze the individual frequency components of the signal in relation to a template of noise components. Other variations of the above scheme are also known, and may be implemented.

The Speech/Noise Detector is initialized by setting the threshold to some pre-set value (usually based on a history of empirically observed energy levels of representative speech and ambient noise). During operation, as the frames are classified, the threshold can be adjusted to reflect the incoming frames, thereby creating a better discrimination between speech and noise.

A typical state-of-the-art Noise Estimator is then utilized to form a quantitative estimate of the signal characteristics of the frame (typically described by its frequency components). This noise estimate is also initialized at the beginning of the input signal and then updated continuously during operation, as more noise signals are received. If a frame is classified as noise by the Speech/Noise Detector, that frame is used to update the running estimate of noise. Typically, the more recent frames of noise received are given greater weight in the computation of the noise estimate.

The Noise Canceller component of the system takes the estimate of the noise from the Noise Estimator, and subtracts it from the signal. A state-of-the-art cancellation method is that of "spectral subtraction", where the subtraction is performed on the frequency components of the signal. This may be accomplished using both linear and non-linear means.

Effectiveness of the overall noise-cancellation system in enhancing the signal, i.e. enhancing the speech, is critically dependent on the noise estimate; a poor or inappropriate estimate will result in the benign error of negligible enhancement, or the malign error of degradation of the speech.

One of the problems with existing speech enhancement systems utilizing noise cancellation relates to the "hands-free" telephony environment.

Typically, in the case of hands-free telephony, such as speaker phones and "hands-free" mobile phones, squelch is incorporated into the telephone when no speech is being input into the microphone, for purposes of reducing echo. This is typically accomplished by attenuating the microphone signal until a pre-determined level of energy is detected at the microphone. The use of squelch results in a very low-level, uniform noise signal at the far end, generally representative of noise on the line, rather than ambient noise near the microphone. Consequently, the noise estimate obtained from a Noise Estimator prior to speech onset (when squelch is present) will not describe target noise, since squelch is not active during speech. A different ambient noise will be present during speech (target noise), and shortly thereafter, until the squelch is re-introduced.

Current noise-cancellation systems will therefore utilize the "squelch" noise sample to subtract from the first speech utterance, which will not be representative of the target noise (noise during speech). Further, the noise following speech, which is representative of the target noise, will be "averaged" with the noise prior to speech in order to arrive at the noise estimate used for cancellation purposes to be applied to subsequent speech utterances. This averaging will once again not be representative of the target noise.

This problem is exacerbated by the fact that "hands-free" operations have a great deal of ambient noise, since the microphone is not next to the speaking person's lips. The signal-to-noise ratio (SNR) for hands-free environments is poor, and can even be less than one. Therefore, in an existing system, the noise estimate used for cancellation will be based on capturing a very low, uniform (squelched) noise signal, and applying that estimate to speech which has different frequency component characteristics and high energy-level (non-squelched) ambient noise, thereby rendering the system's cancellation process ineffective when it is needed most (in a noisy hands-free environment).

Also, if there is enough silence between speech utterances, the squelch will kick back in, rendering the subsequent series of noise samples likewise unrepresentative of target noise.

Additionally, in the case of isolated utterance speech recognition systems (where the input is typically a single utterance followed by silence), combined with a hands-free environment, a typical existing system would not reduce ambient noise (and might indeed introduce additional noise or degrade the speech). Where there is a single utterance, existing systems would use the pre-speech noise (squelched) and apply it to the utterance (where squelch would not be present). There would be no opportunity to measure and apply post-speech noise samples to the single utterance.

Another drawback to existing noise-reduction systems occurs in situations involving dynamically directional microphones and voice-activated microphones. In each case, the ambient noise during speech will more closely approximate the noise immediately following speech than the noise immediately preceding speech. This is due to the fact that the environment picked up by microphones for input into the system changes radically once speech begins, but does not return to the initial state until some period of time following speech. Therefore, current systems would use the unrepresentative noise prior to speech to enhance the speech, resulting in poor performance.

BRIEF DESCRIPTION OF THE INVENTION

The foregoing drawbacks are overcome by the present invention.

What is disclosed is a method and system of noise cancellation which can be used to provide effective speech enhancement in environments involving hands-free telephony or other situations where squelch-type technology is in effect, or more generally, when post-speech noise is more representative of target noise than pre-speech noise.

An implementation of the method and system is briefly described as follows:

Added to a standard noise cancellation system is the Supervisory Control. This directs the Noise Estimator to re-initialize after speech ends, and freeze the estimate of noise once a sufficient number of post-speech noise samples have been calculated.

This inventive system, when applied in a hands-free environment where squelch is utilized, captures a sample of noise which will closely approximate the ambient noise during speech. Then, the system can utilize this sample either on a going-forward only basis, or in the case of a voice recognition system, or other appropriate circumstances, can also enhance previous speech utterances via a post-processing arrangement.

Those skilled in the art can readily see obvious variations to the above invention which are included in the general description of the invention, but which are not specifically detailed herein.

DETAILED DESCRIPTION OF THE INVENTION

In the proposed system and method, greater effectiveness of noise cancellation is achieved by controlling the components of the system such that the "target noise", that is the noise present during speech, is better obtained by the Noise Estimator.

Figure 1:
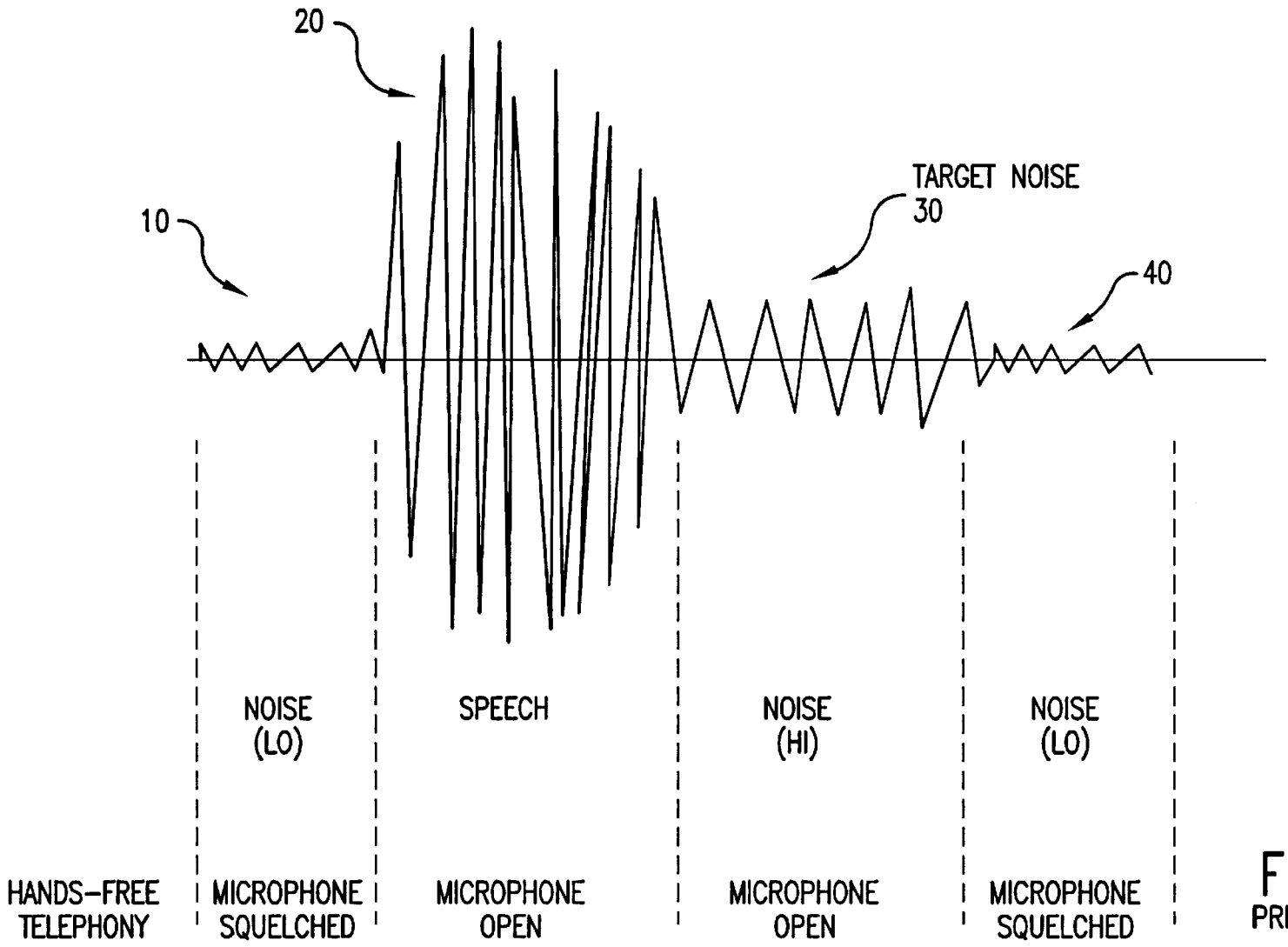
FIG. 1 PRIOR ART
FIG. 1 shows a typical audio signal during hands-free telephony utilizing squelch technology.

FIG. 1 shows a simplified representation of an audio signal when squelch technology is employed. Noise 10 represents the squelch state prior to speech. Speech 20 disables the squelch, and ambient noise is included in speech 20. Noise 30 follows speech 20, and is representative of the ambient noise of the environment without squelch being active (target noise). Noise 40 is similar to noise 10 and represents the situation of squelch being active in the absence of speech.

Figure 2:
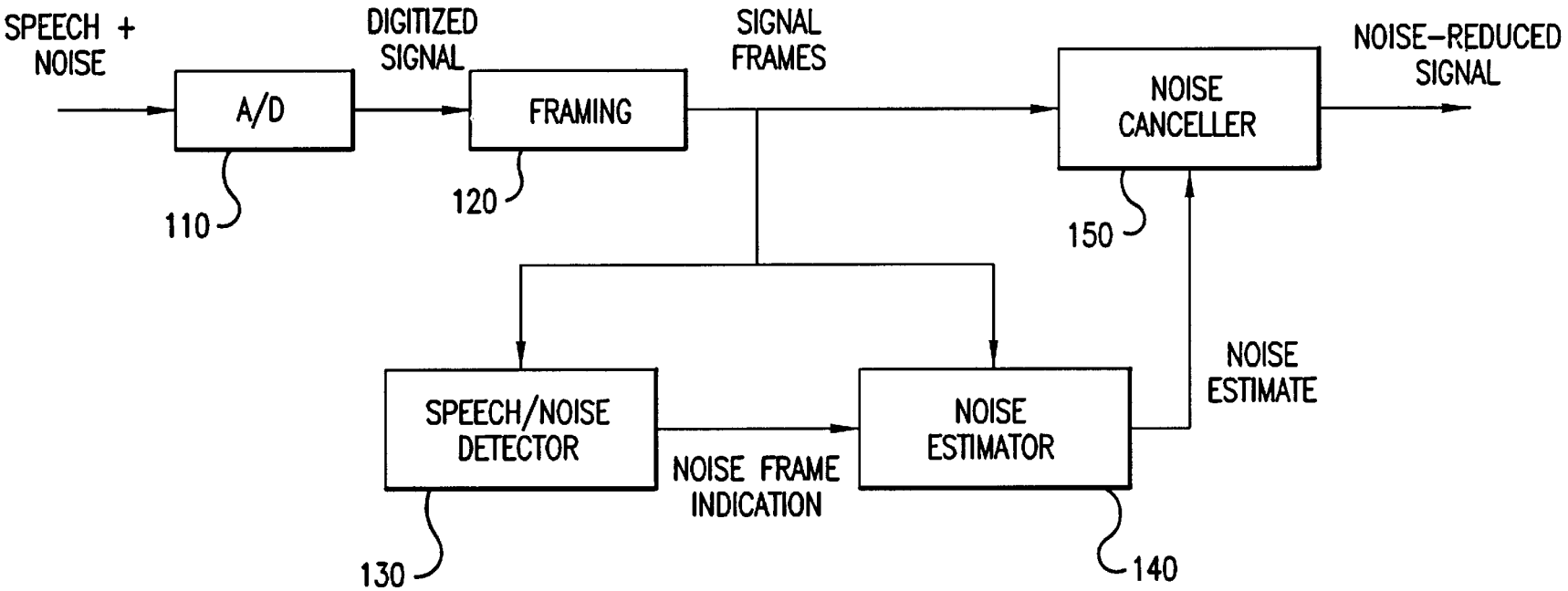
FIG.2 PRIOR ART
FIG. 2 shows a block diagram of an existing noise canceling system.

FIG. 2 depicts a typical, real-time noise cancellation system. The audio signal enters analog/digital converter (A/D 110) where the analog signal is digitized. The digitized signal output of A/D 110 is then divided into individual frames within framing 120. The resultant signal frames are then simultaneously inputted into noise canceller 150, speech/noise detector 130, and noise estimator 140.

When speech/noise detector 130 determines that a frame is noise, it signals noise estimator 140 that the frame should be input into the noise estimate algorithm. Noise estimator 140 then characterizes the noise in the designated frame, such as by a quantitative estimate of its frequency components. This estimate is then averaged with subsequently received frames of "speechless noise", typically with a gradually lessening weighting for older frames as more recent frames are received (as the earlier frame estimates become "stale"). In this way, noise estimator 140 continuously calculates an estimate of noise characteristics.

Noise estimator 140 continuously inputs its most recent noise estimate into noise canceller 150. Noise canceller 150 then continuously subtracts the estimated noise characteristics from the characteristics of the signal frames received from framing 120, resulting in the output of a noise-reduced signal.

Speech/noise detector 130 is often designed such that its energy threshold amount separating speech from noise is continuously updated as actual signal frames are received, so that the threshold can more accurately predict the boundary between speech and non-speech in the actual signal frames being received from framing 120. This can be accomplished by updating the threshold from input frames classified as noise only, or by updating the threshold from frames identified as either speech or noise.

Figure 3:
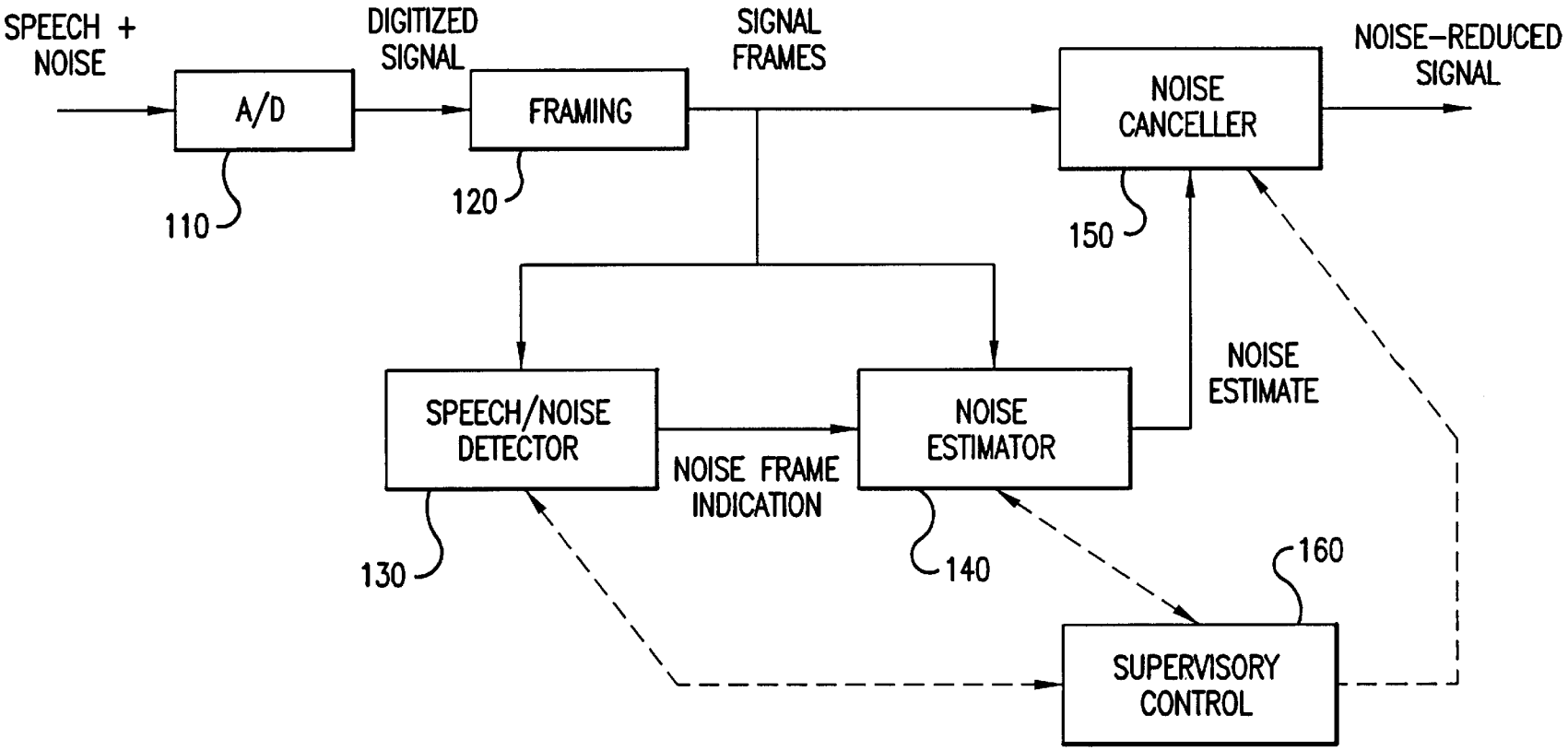
FIG. 3 shows a block diagram of the inventive system.

FIG. 3 depicts the inventive addition of supervisory control 160 to a typical noise cancellation system. An advantageous way of deploying such a system is on a general purpose computer. A/D 110 would typically be performed by hardware outside the computer. The remainder of the block diagram of FIG. 3 would be implemented via software in the computer. Speech/noise detector 130 can be readily modified, following known algorithmic methods, to additionally detect and signal "speech onset" to supervisory control 160, when a pre-determined number of adjacent frames of speech representing a pre-determined duration (advantageously 80–100 milliseconds) are detected. Operationally, Speech/noise detector 130 would detect a frame of "non-noise". Then, when a sufficient number of non-noise frames have been detected, Speech/noise detector 130 would identify "speech onset". Such processes are widely used in speech detection systems.

Once post-speech noise is detected, supervisory control 160 directs speech/noise detector 130 to re-initialize (effectively erasing the knowledge of characteristics of noise prior to speech onset). In the speech/noise detector 130 algorithm, if the speech/noise distinguishing threshold is computed from the current noise estimate only, that is also re-initialized; if it is computed jointly from noise and speech estimates, it may be computed based on the current speech estimate and re-initialized noise estimate.

Once an adequate number of post-speech noise samples are estimated in noise estimator 140, that estimate is frozen and speech/noise detector 130 and noise estimator 140 are disabled. The frozen estimate is forwarded to noise canceller 150. This post-speech noise estimate is a more reliable estimate of the "target noise" than obtained by conventional means.

While supervisory control 160 is operating, prior to re-initialization and disabling signals being sent out, speech/noise detector 130 and noise estimator 140 operate as usual. When speech/noise detector 130 detects a noise frame, noise estimator 140 updates its estimate with this new information.

Figure 4:
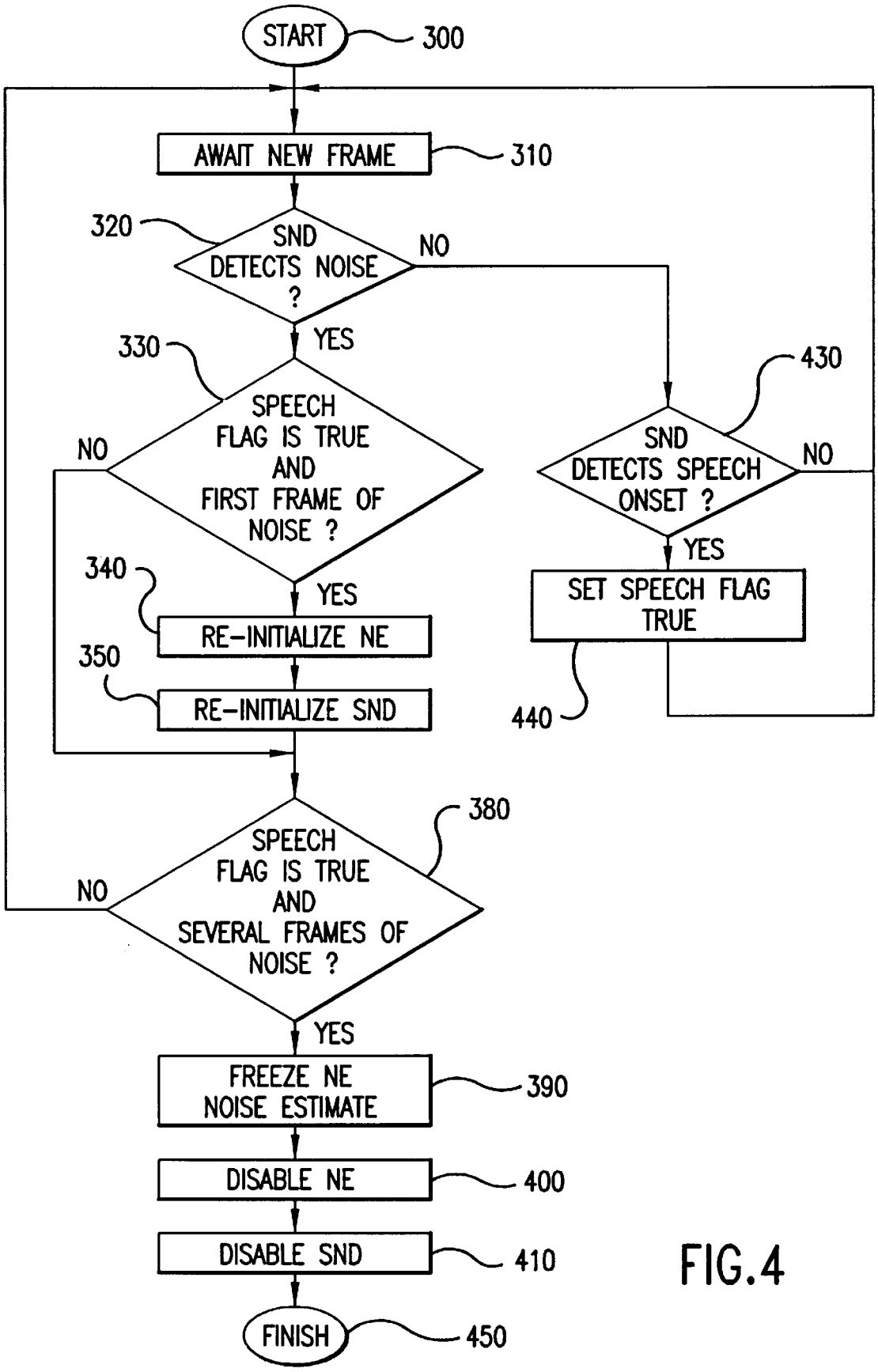
FIG. 4 shows a flow chart of the Supervisory Control.

FIG. 4 is a flow chart representing the operation of supervisory control 160. Supervisory control 160 utilizes the input from speech/noise detector 130 for its decision making, and outputs control signals to speech/noise detector 130 and noise estimator 140. Each time a frame is sent from framing to speech/noise detector 130, supervisory control 160 is notified, as represented in block 310. Then, speech/noise detector 130 classifies the frame as either noise or non-noise, and further, if the frame is non-noise, whether speech onset has occurred. Speech/noise detector 130 then sends the appropriate message to supervisory control 160 at block 320.

For illustrative purposes, assume that the incoming signal consists of numerous frames of noise, followed by numerous frames of speech, followed by numerous frames of noise. The first frame would therefore be seen at block 320 as noise, and next block 330 would check the "speech flag" (described below) to see if the noise follows speech. Since the first frame does not follow speech, block 330 would lead to block 380, which would result in a negative result, returning to block 320.

Because each successive noise frame noted by block 320 would cycle through blocks 310, 320, 330, and 380, supervisory control 160 would not cause interrupt the normal functionings of speech/noise detector 130 and noise estimator 140 in updating speech/noise thresholds and updating the noise estimate.

When the first non-noise frame is noted by speech/noise detector 130 at block 320, block 430 would check to see if speech/noise detector 130 detected speech. Since the first speech frame would not meet speech/noise detector 130's threshold of three consecutive frames of speech (representing a minimum duration of speech, advantageously 80–100 milliseconds) before noting speech onset, block 430 would be negative, and supervisory control 160 would await the next frame (control returned to block 310). Once speech/noise detector 130 detected the third consecutive speech frame, it would notify supervisory control 160 of speech onset. At this point, block 430 would pass to block 440, which would set the speech flag to "true". Subsequent frames of speech would cause the speech flag to remain "true".

When the first frame of noise after speech is detected at block 320, block 330 would check the speech flag, and since that flag is now "true", and the current frame is the first noise frame passing through block 330 with the speech flag on, block 340 would re-initialize noise estimator 140, block 350 would re-initialize speech/noise detector 130, and block 380 would note that a sufficient number of noise frames after speech onset had not been received (beneficially a number representing a duration of about 100 milliseconds), and therefore pass control back to block 310. For a frame duration of 20 milliseconds, this number would be 5 frames. Generally, if the frame size is varied, the threshold number of frames would vary accordingly.

In this way, once noise is detected following speech onset and therefore should be representative of target noise (non-squelch ambient noise), speech/noise detector 130 and noise estimator 140 are re-set, so that all prior history of pre-speech (squelched) noise is purged. However, history of speech frames may be beneficially retained for purposes of determining the speech/noise threshold.

When the next noise frame after speech onset is noted by block 320, block 330 is then negative, and block 380 remains negative. This results in the cycling back to block 310, and noise estimator 140 (of FIG. 3) updating the noise estimate with each newly received noise frame.

When the fifth noise frame after speech onset is detected by block 320, control is again passed to block 380. Since the fifth noise frame meets the threshold established to capture an adequate noise sample, block 390 freezes noise estimator 140's estimate of noise, block 400 disables noise estimator 140 so that no updates to the estimate are made, and block 410 disables speech/noise detector 130, so that no new noise frames are identified to noise estimator 140.

At this point, an adequate sample (5 frames) of target noise has been sent to noise estimator 140 (of FIG. 3). Subsequent periods of squelched noise will not be permitted to degrade this estimate.

Many variations of this method would be apparent to those skilled in the art of speech enhancement. For instance, block 380 could be set to only accept a pre-determined number of consecutive frames of postspeech noise. This might more accurately estimate target noise, but might miss cancellation of speech which occurred after 5 target noise frames but prior to 5 consecutive target noise frames.

Also, the "frozen" post-speech estimate can be set to operate for a finite amount of time, or until a new speech segment begins. At such time, a new sequence as depicted in FIG. 4 can be initiated.

Figure 5:
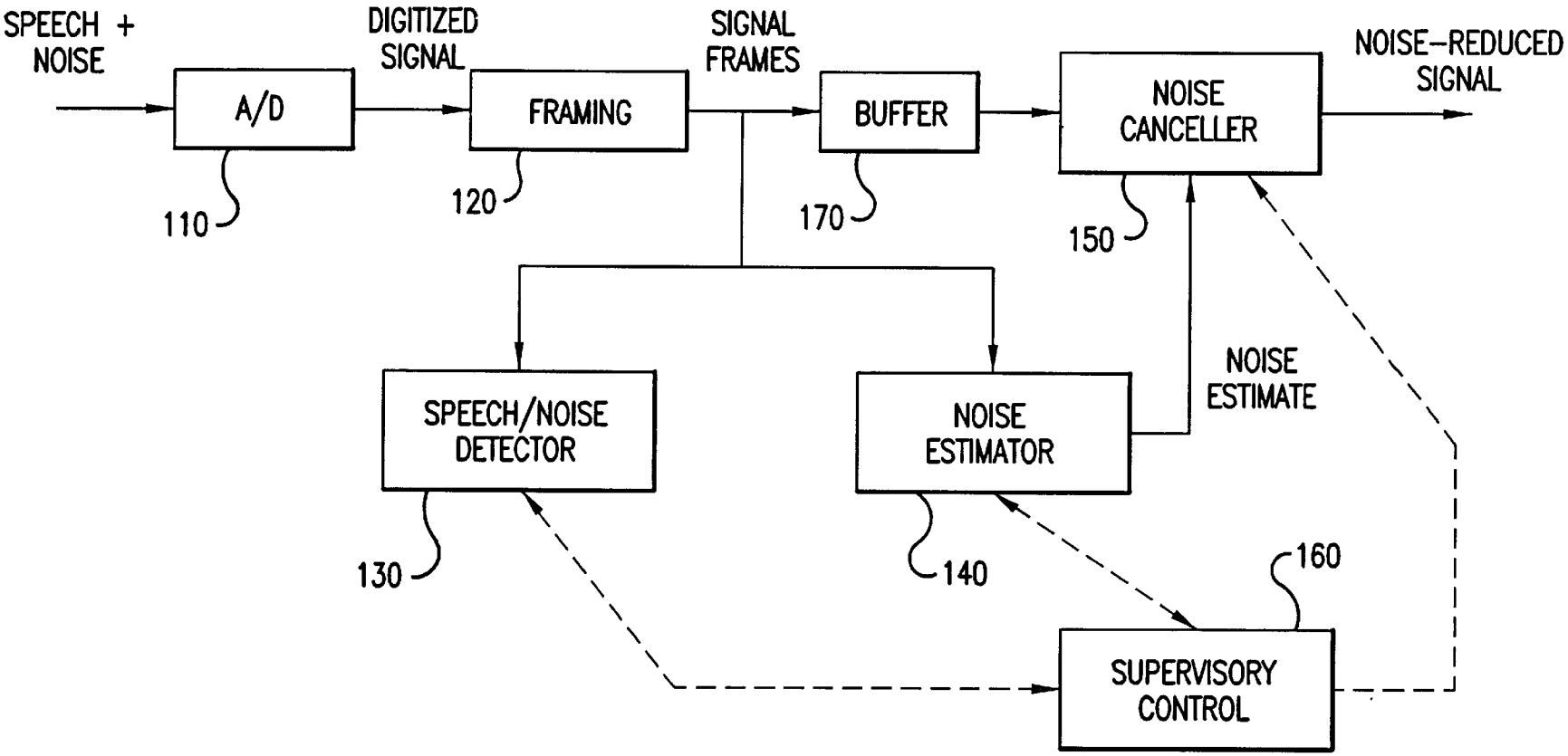
FIG. 5 shows a block diagram of a delayed-processing implementation of the invention.

FIG. 5 displays an alternative post-processing system capable of enhancing the first speech utterance with post speech target noise estimates. Post-processing in speech enhancement is known, but it is inventive to combine such a process with the targeting of post-speech noise for cancellation purposes.

In FIG. 5, buffer 170 is interposed in front of noise canceller 150. In this way, if the size of the buffer is 3 seconds, and the speech utterance is 2 seconds, 5 frames of post-speech noise would be used for estimation purposes at noise estimator 140 to cancel the ambient noise during the initial 2-second speech utterance at noise canceller 150.

Where there are lesser constraints on the allowable time-delay, greater than 3 seconds of buffering can be implemented, thereby resulting in the enhancement of a longer initial speech utterance. Conversely, where delay is problematic, a shorter buffer delay can still show an improvement over existing systems whenever post-speech noise is more representative of target noise than is pre-speech noise.

Note that noise cancellation systems for speech enhancement and recognition are of most value in high-noise situations, among which mobile telephony is a dominant application, as evidenced by the literature. In the common case of hands-free mobile telephony, squelch is typically incorporated into the telephone for purposes of reducing double-talk or echo. Consequently, the noise estimate obtained from the Noise Estimator prior to speech onset will not describe target noise, but the methods and systems described herein correctly estimate target noise.

What is claimed is:

1. In a noise reduction system, a method of estimating background noise, comprising the steps of:

classifying input frames as either speech or noise, identifying a preselected number of frames of noise following speech, and disabling the use of subsequent frames for cancellation purposes.

2. The method of claim 1 wherein the preselected number of frames are utilized for estimating for cancellation on previously stored speech frames.

3. A noise reduction system, comprising:

a speech/noise detector, a noise estimator which monitors the speech/noise detector to identify noise frames, a noise canceller responsive to noise estimates provided by the noise estimator for cancelling noise from speech, and a supervisory control which monitors the speech/noise detector to identify a set of a preselected number of noise frames following speech and disables the noise canceller from utilizing noise frames subsequent to the set for cancelling noise from speech.

4. The system of claim 3 wherein the supervisory control directs the noise estimator and the noise canceller to update the noise estimate based upon a set of noise frames following a second speech segment.

5. A noise reduction system, comprising:

a speech/noise detector;

a noise estimator which monitors the speech/noise detector to identify noise frames, a noise canceller responsive to noise estimates provided by the noise estimator for cancelling noise from speech, a supervisory control which monitors the speech/noise detector to identify a set of a preselected number of noise frames following speech and disables the noise estimator from utilizing noise estimates from frames of noise received subsequent to the set for estimating noise.

6. A noise reduction system, comprising:

detecting means for detecting whether a frames of signal is noise or speech, identifying means associated with the detecting means for identifying a set of a pre-selected number of noise frames following speech, estimating means associated with the identifying means for estimating the noise of the set, cancelling means associated with the estimating means for cancelling the estimated noise from the signal, and disabling means for disabling the cancellation of estimated noise from frames received after the set.

7. A noise reduction system, comprising:

a speech/noise detector, a noise estimator receiving identification of noise frames from the speech/noise detector, a noise canceller responsive to noise estimates provided by the noise estimator for cancelling noise from speech, and means associated with the speech/noise detector and the noise estimator for identifying a set of a pre-determined number of noise frames following speech and directing the noise estimator not to use frames received subsequent to the set for noise estimation purposes.

8. A noise reduction system, comprising:

speech/noise detector, a noise estimator receiving identification of noise frames from the speech/noise detector, a noise canceller responsive to noise estimates provided by the noise estimator for cancelling noise from speech, and means associated with the speech/noise detector and the noise estimator for identifying a set of a pre-selected number of noise frames following speech and directing the noise canceller not to use frames received subsequent to the set for noise cancellation purposes.

9. In a general purpose computer, performing the steps of:

receiving a digitized communication signal, dividing the signal into frames, classifying the frames as either speech of noise, identifying a predetermined number of frames of noise following speech, utilizing the identified frames to estimate noise, and disabling the use of subsequent frames for cancellation of noise from the signal.

10. In a hands-free telephony environment, a method of reducing background noise, comprising the steps of:

identifying segments of an incoming signal as either noise or speech, cancelling the noise in the signal by spectrally subtracting an estimate of a pre-selected interval of noise immediately following speech and disabling the estimation of noise subsequent to the interval.

11. In a noise reduction system, a method of reducing noise, comprising the steps of:

classifying input frames as either speech or noise, identifying a first preselected length segment of noise immediately following a first plurality of frames of speech, cancelling noise from a first plurality of input frames based on said first preselected length segment of noise;

identifying a second preselected length segment of noise immediately following a second plurality of frames of speech, and cancelling noise from a second plurality of input frames based on said second preselected length segment of noise.

12. The method of claim 11 wherein the segment is utilzed for cancellation of noise in previously stored speech.

13. In a noise-reduction system, the method comprising the steps of:

classifying input signal frames as noise or speech, identifying a pre-determined number of contiguous speech frames representing speech onset, identifying a pre-determined number of noise frames immediately following speech, obtaining a noise estimate from the identified noise frames, spectrally subtracting the noise estimate from the subsequent next received input signal frames, and disabling the use of noise frames following the identified noise frames for spectral subtraction.

14. The method of claim 13 with the additional steps of:

storing the inputted signal frames, and spectrally subtracting the noise estimate from the stored frames.

15. The method of claim 13 wherein the identified noise frames must be contiguous.

* * * * *